United States Patent [19]

Crum

[11] Patent Number: 4,863,215

[45] Date of Patent: Sep. 5, 1989

[54] ACTION FURNITURE MECHANISM

[75] Inventor: Michael A. Crum, Bagdad, Ky.

[73] Assignee: Leggett & Platt, Incorporated, Carthage, Mo.

[21] Appl. No.: 277,711

[22] Filed: Nov. 30, 1988

[51] Int. Cl.[4] ..... A47C 1/02

[52] U.S. Cl. ..... 297/85; 297/68

[58] Field of Search ..... 297/68, 69, 83, 84, 297/85, 317, 327

[56] References Cited

U.S. PATENT DOCUMENTS

| | | | |
|---|---|---|---|
| 3,269,769 | 8/1966 | Mizelle | 297/85 |
| 3,284,131 | 11/1966 | Fletcher | 297/85 |
| 3,400,975 | 9/1968 | Rogers, Jr. | 297/85 |
| 3,433,527 | 3/1969 | Ré | 297/85 |
| 4,108,491 | 8/1978 | Rogers, Jr. | 297/85 |
| 4,249,772 | 2/1981 | Rogers, Jr. | 297/85 |
| 4,740,031 | 4/1988 | Rogers, Jr. | 297/85 |

*Primary Examiner*—Peter R. Brown

*Attorney, Agent, or Firm*—Wood, Herron & Evans

[57] ABSTRACT

An improved linkage mechanism for use in a reclining item of action furniture having a movable seat, backrest and footrest, the mechanism being so constructed as to move the seat and backrest away from a wall immediately behind the backrest as the item of furniture moves from an upright to a TV or fully reclined position. Thereby, the backrest is prevented from contacting the wall behind the item of furniture during its movement to a fully reclined position. The mechanism is so constructed that a weight applied to the footrest when the mechanism is fully reclined will cause the mechanism to move from the fully reclined to the TV position and ultimately to the upright position.

6 Claims, 3 Drawing Sheets

ACTION FURNITURE MECHANISM

This invention relates to action furniture of the type which has a movable seat and backrest in combination with a footrest, the connection being such that the seat and backrest may be moved between upright, TV and fully reclined positions, while the footrest is movable between a fully retracted position when the seat and backrest are in an upright position and an extended position when the seat and backrest are in a TV or fully reclined position.

Action mechanisms are now commonly used in recliner chairs and in sofas wherein the backrest of the chair or sofa is located against a wall with the mechanism being so constructed that as the item of furniture moves from upright to TV or fully reclined position, the seat and backrest move away from the wall in order that the backrest may be angled rearwardly without the backrest contacting the wall. While many such mechanisms are now in existence, they are in many cases overly complex and expensive, and in some instances, subject to breakage in the event that the mechanism is utilized improperly. In other instances, the mechanisms are relatively difficult to operate, particularly for very lightweight persons when seated in the item of furniture wherein the mechanism is located.

It has therefore been an objective of this invention to provide an improved action mechanism for an item of furniture which is very easy to operate and which utilizes a minimum of components or parts so as to minimize the cost of the mechanism.

One shortcoming or problem commonly incurred with action chair or recliner mechanisms is that of having a person sit down upon the footrest when the footrest is fully extended and the chair or item of furniture is in the fully reclined position. In many instances, this will result in the mechanisms being bent or broken because the mechanisms are designed to first be moved into the intermediate or TV position before the footrest can begin to collapse into the retracted position of the footrest in the mechanism.

It has therefore been another objective of this invention to provide an improved mechanism wherein a downward force on the footrest while the seat, backrest and footrest are fully reclined will cause the footrest to move the mechanism to the TV, and subsequently to the upright, position of the mechanism.

The invention of this application which accomplishes these objectives comprises a base mounting plate, front and rear seat drive links pivotally mounted to the base mounting plate at locations spaced along the base mounting plate, a seat link, seat link supporting means for supporting the seat link from the front and rear seat drive links, a backrest pivotally connected to the rear of the seat link, a backrest support link pivotally connected at one end to the backrest support link and at an opposite end to the seat supporting means, a footrest linkage pivotally connected to the front of the seat link for movement of the footrest linkage between extended and retracted positions, and a footrest linkage actuating means for moving the footrest linkage and seat link between upright, TV and fully reclined positions. In accordance with the practice of this invention, the mechanism includes a backrest sequence link connected by a pin and slot connection to the backrest link and pivotally connected to the footrest linkage actuating means so as to prevent movement of the backrest link when the footrest is fully retracted while permitting movement of the backrest link relative to the seat link whenever the footrest linkage and seat link are in either TV or fully reclined positions. In accordance with another aspect of this invention, the seat supporting means which interconnects the seat link to the front and rear seat drive links comprises a rear seat actuating link pivotally connected by a first pivot connection to the rear seat drive link and to the seat link by a second pivot connection, a front seat pivot link pivotally connected to the seat link, and a connecting link, which connecting link is connected at one end to the front drive link and at the opposite end to the rear seat actuating link with an intermediate portion of the connecting link being connected to the front seat pivot link.

The advantage of this mechanism over prior art mechanisms is that it is in many instances easier to operate over a full range of body weights by a person seated in a chair incorporating the mechanism, and it is in many instances less expensive to manufacture than prior art mechanisms of the same general operational characteristics. It also has the advantage of permitting the mechanism to close when a person or weight is placed on the end of the footrest in either the TV or fully reclined position of the mechanism.

These and other objects and advantages of this invention will become more readily apparent from the following description of the drawings in which.

Figure 1:
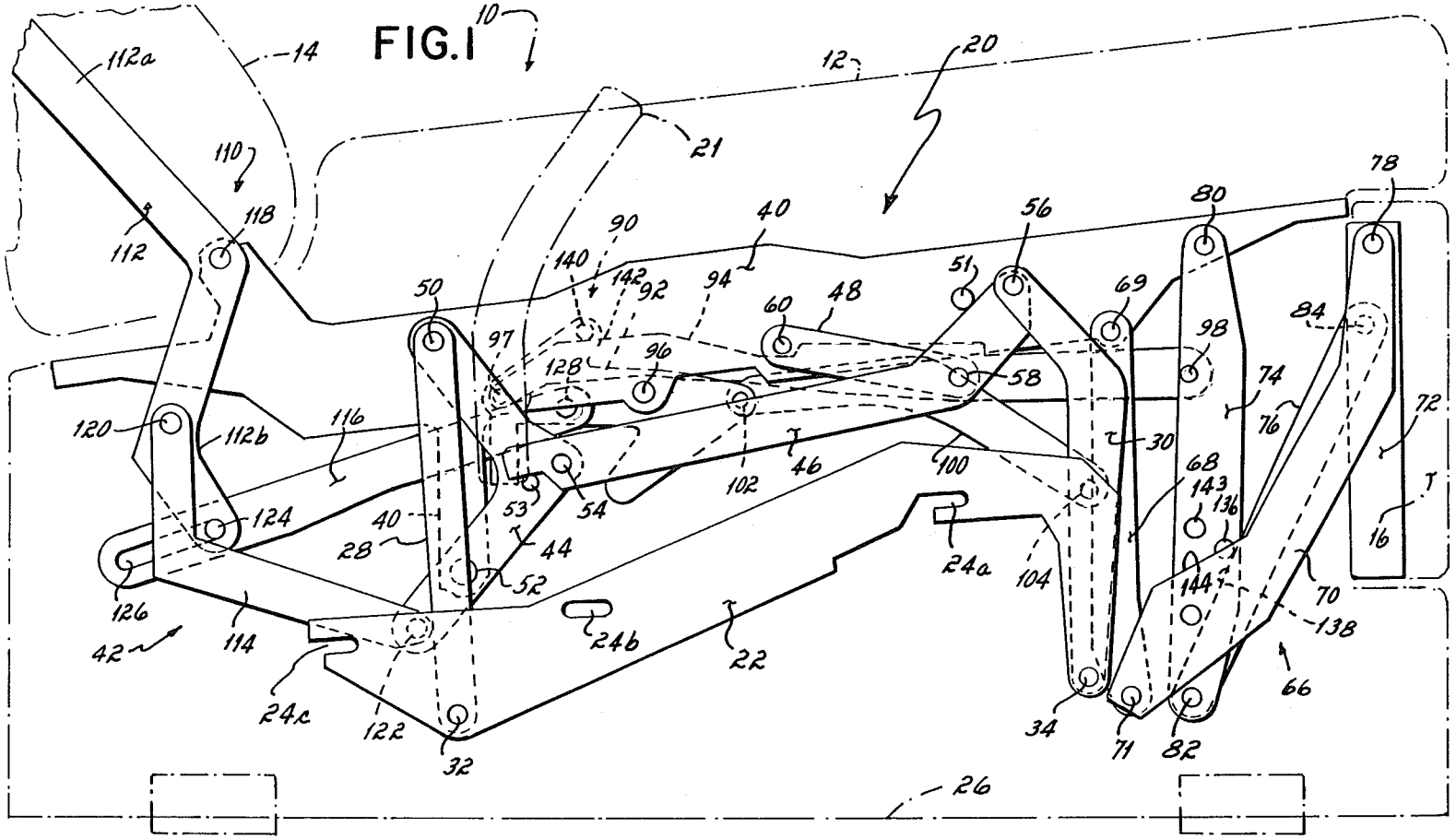
FIG. 1 is a side elevational view of an item of action furniture, which could be a reclining chair, incorporating a preferred embodiment of the inventive mechanism with the mechanism being shown in an upright position in which the footrest is fully retracted.

With reference first to FIG. 1, there is illustrated an item of action furniture 10 which could be a reclining chair or a sofa or any type of action furniture which utilizes a movable seat 12 and backrest 14 in combination with a movable footrest 16. In the preferred embodiment, the item of action furniture with which the invention of this application is employed is a reclining chair, but it could as well be a reclining sofa or any other type of action furniture which utilizes a seat, backrest and footrest movable between upright, intermediate or TV and fully reclined positions. To accomplish this movement of the seat, backrest and footrest, the item 10 of action furniture incorporates the novel linkage mechanism 20 of this invention.

LINKAGE MECHANISM

The linkage mechanism 20 comprises two substantially identical mechanisms located on opposite sides of the item of furniture and interconnected by appropriate crosspieces or crossbars (not shown). Since the two mechanisms are substantially identical and mirror images of each other, the one difference being the presence of a handle 21 on one side only of the mechanism 20. For purposes of simplifying the drawings, the handle 21 is illustrated in phantom in FIG. 1 only.

The linkage mechanism 20 comprises a base mounting plate 22 having slots 24*a*, 24*b*, 24*c* formed therein for facilitating attachment of the mounting plate to a floor mounted side rail 26 of the item of furniture 10. Extending upwardly from this mounting plate 22 there are a pair of drive links 28, 30. One of these drive links, the rear drive link 28, is pivotally attached to the rear of the mounting plate 22 by a pivot connection 32 on the lower end of the rear drive link. The other drive link, the front drive link 30, is pivotally connected by a pivot connection 34 to the front of the mounting plate. A seat link 40 is supported from the front and rear drive links 28, 30 by a seat supporting linkage means 42. This seat supporting linkage means 42 comprises a rear seat actuating link 44, a connecting link 46, and a front seat pivot link 48. The seat 12 of the chair or item of action furniture 10 is supported atop the seat link 40 on an inwardly turned flange 40*a* thereof.

To support the seat rail 40 from the drive links 28, 30, the rear seat actuating link 44 is pivotally connected to the top of the rear drive link 28 by a pivot connection 50. The rear seat actuating link 44 is generally bell-crank shaped and is pivotally connected adjacent its lower end to the seat link 40 by a pivot connection 52. Intermediate its ends, the seat actuating link 44 is pivotally connected to the rear of the connecting link 46 by a pivot connection 54. At its forward end, the connecting link 46 is pivotally connected by a pivot connection 56 to the upper end of the front drive link 30. Intermediate its ends, the connecting link 46 is connected by a pivot connection 58 to the lower end of the front seat pivot link 48. The upper end of the front seat pivot link 48 is connected by a pivot connection 60 to the seat link 40. In the upright position of the mechanism and in the TV position, a stud 51 of the seat link 40 rests atop the connecting link 46, and the rear of the connecting link 46 rests atop a stud 53 of the rear seat actuating link 44. As a result of these pivot connections, the seat link 40 is supported from the drive links via the rear seat actuating link 44 at the rear and by the connecting link 46 and front seat pivot link 48 at the front.

FOOTREST LINKAGE

A footrest linkage 66 is suspended from the front of the seat link 40. This footrest linkage 66 comprises a rear footrest link 68, a front footrest link 70, a footrest support link 72, and first and second footrest connecting links 74 and 76, respectively. The rear footrest link 68 is pivotally connected at its upper end to the seat link 40 by a pivot connection 77 and its lower end by a pivot connection 71 to the front footrest link 70. The upper end of the front footrest link is in turn pivotally connected by a pivot connection 78 to the footrest link 72. The first footrest connecting link 74 is pivotally connected at its upper end by a pivot connection 80 to the seat link 40 and at its lower end by a pivot connection 82 to the second footrest connecting link 76. At its upper end, the second footrest connecting link 76 is connected by a pivot connection 84 to the footrest link 72. The footrest 16 is in turn fixedly attached to the front face or upper face of the footrest link 72.

In order to effect extension and retraction of the footrest, the linkage mechanism 20 includes a footrest actuating linkage 90. This footrest actuating linkage 90 includes a generally Z-shaped handle link 92 and a footrest drive link 94. The handle link 92 is pivotally connected by a pivot connection 96 to the seat link 40 and is rotatable relative to that seat link by the handle 21.

The footrest drive link 94 is pivotally connected to the handle link 92 by a pivot connection 97 at the rear end of the footrest drive link. The forward end of the footrest drive link is pivotally connected by a pivot connection 98 to the first footrest connecting link 74 at a point intermediate the opposite ends of the first footrest connecting link. The connection is such that rotation of the handle causes the footrest drive link to move forwardly toward the footrest and push the footrest outwardly from a retracted to an extended position.

Also pivotally connected to the handle link 92 is a ratio connecting link 100. This ratio connecting link is pivotally connected at the rear to the handle link 92 by a pivot connection 102 and is pivotally connected at the front end to the front drive link 30 by a pivot connection 104. As explained more fully hereinafter, when the handle link is rotated counterclockwise, as viewed in FIG. 1, relative to the pivot 96, it causes the ratio connecting link 100 to pull the seat link 40 forwardly and simultaneously rotate the front drive link 30 clockwise about its lower front pivot 34. Consequently, rotation of the handle and handle link 92 in a counterclockwise direction, as viewed in FIG. 1, results in the seat link 40 being pulled forwardly as the front and rear drive links rotate in a clockwise direction, as viewed in this same Figure.

BACKREST LINKAGE

The linkage mechanism 20 includes a backrest linkage 110 for supporting the backrest 14 for pivotal movement relative to the seat 12. This backrest linkage comprises a backrest link 112, a backrest support link 114, and a backrest sequence link 116. The backrest link 112 has an upper section 112*a* which is connected to the backrest 14. It also has a lower bell-crank-shaped section 112*b*. The backrest link is connected intermediate these two sections to the seat link 40 by a pivot connection 118. The backrest support link 114 is also bell crank shaped. It has an upper end pivotally connected by a pivot connection 120 to the lower section 112*b* of the backrest link and a lower end connected by a pivot connection 122 to the lower end of the rear seat actuating link 44. The backrest sequence link 116 extends between the handle link 92 and the lower end of the backrest link 112. There is a pin and slot connection between the sequence link and the backrest link. This pin and slot connection takes the form of a pin 124 of the backrest link 112 which extends through an elongated slot 126 of the sequence link. At its forward end, the sequence link 116 is connected to the handle link 92 by a pivot connection 128.

OPERATION OF THE LINKAGE MECHANISM 20

Figures 2, 3:
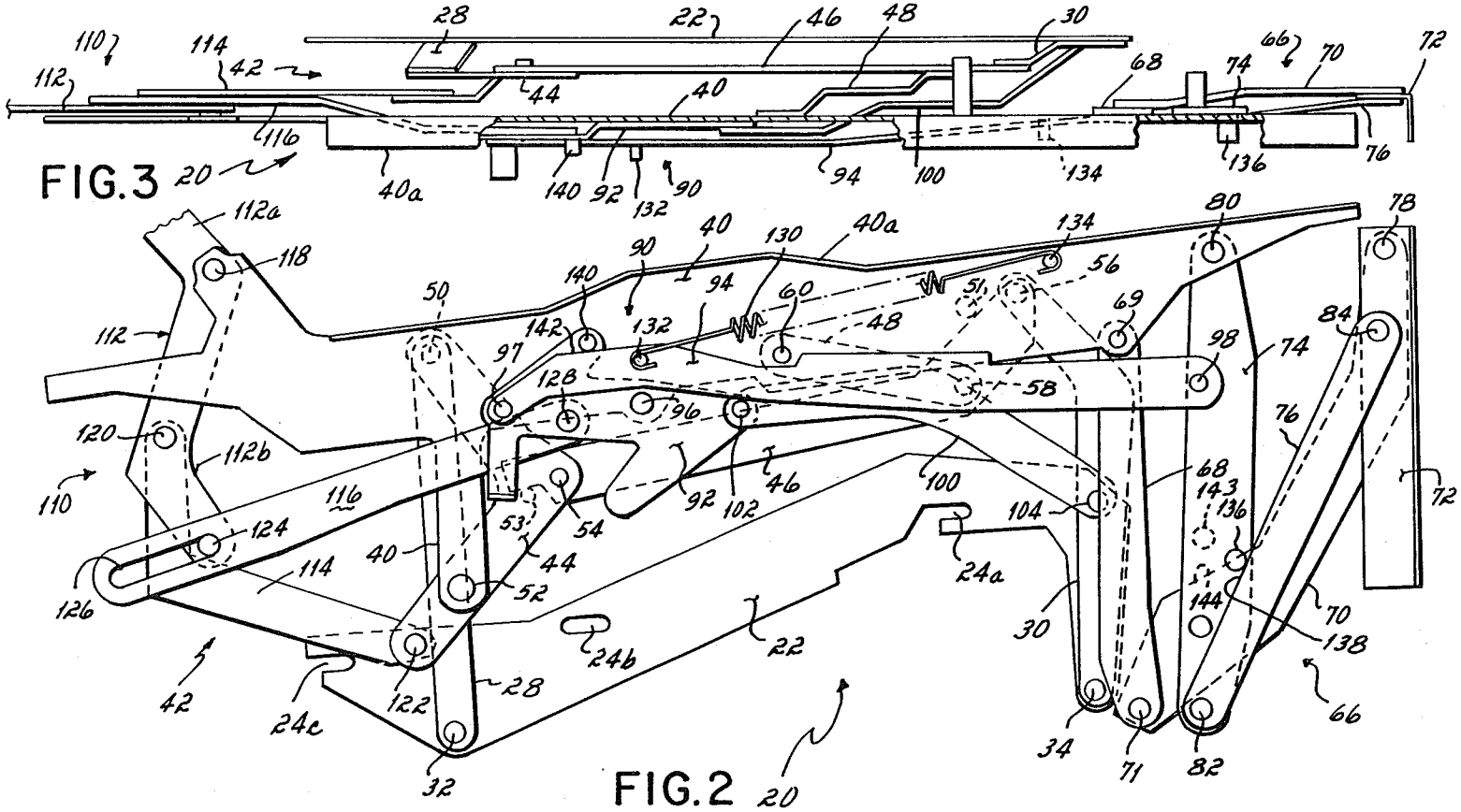
FIG. 2 is a view similar to FIG. 1, but illustrating the opposite side of the mechanism in the same upright position.
FIG. 3 is a top plan view of the mechanism of FIGS. 1 and 2.

Assuming that the linkage mechanism 20 is in the upright position of the linkage with the footrest linkage 66 fully retracted, as illustrated in FIGS. 1 and 2, the mechanism is maintained in this position by a spring 130 which extends between a headed rivet 132 of the footrest drive link 94 and a headed rivet 134 of the seat link 40. In the retracted position of the footrest, this spring applies a biasing force to the footrest linkage 66 which causes the linkage to be maintained in a retracted position wherein a stop stud 136 of the first footrest connecting link is engaged with a top surface 138 of the footrest connecting link 76. In this position, a stop stud 140 of the handle link is also engaged with the top surface 142 of the footrest drive link 94.

When a person is seated in the chair or the unit of action furniture 10 and the mechanism is in the upright position with the footrest fully retracted, the weight of the person seated in the chair tends to bias the seat link 40 rearwardly because of the orientation of the pivot connections 34, 56 between the front drive link 30 and the mounting plate 22 and the front drive link 30 and seat link 40, respectively. In order to initiate reclining movement of the chair, the seat link 40 must be moved forwardly to a point at which the pivot connection 56 of the front drive link moves forwardly of the pivot connection 34 of this same front drive link. When this occurs, the weight of the person seated in the chair tends to continue to force the drive links to pivot in a clockwise direction about their pivot connections 32, 34 with the mounting plate 22.

To initiate forward reclining movement of the seat link 40 relative to the base link 22, the handle 21 and the attached handle link 92 must be moved in a counterclockwise direction as viewed in FIG. 1. This movement of the handle results in the footrest linkage 66 being moved forwardly by the footrest drive link 94. Once this reclining movement is initiated by rotation of the handle link 92, and as soon as the pivot 56 of the front drive link 30 moves forwardly of the lower pivot connection 34 of this same front drive link, the opening or extending movement of the footrest linkage will continue as a consequence of the weight of the person in the chair causing clockwise rotation of the front drive link 34 and forward movement of the seat link 30 through the ratio connecting link 100. This opening movement of the footrest linkage will continue until a second stop stud 143 of the first footrest connecting link contacts a stop surface 144 of the front footrest link 70. This is the intermediate or TV position of the linkage mechanism 20. This position of the mechanism is illustrated in FIG. 5.

Figures 4, 5:
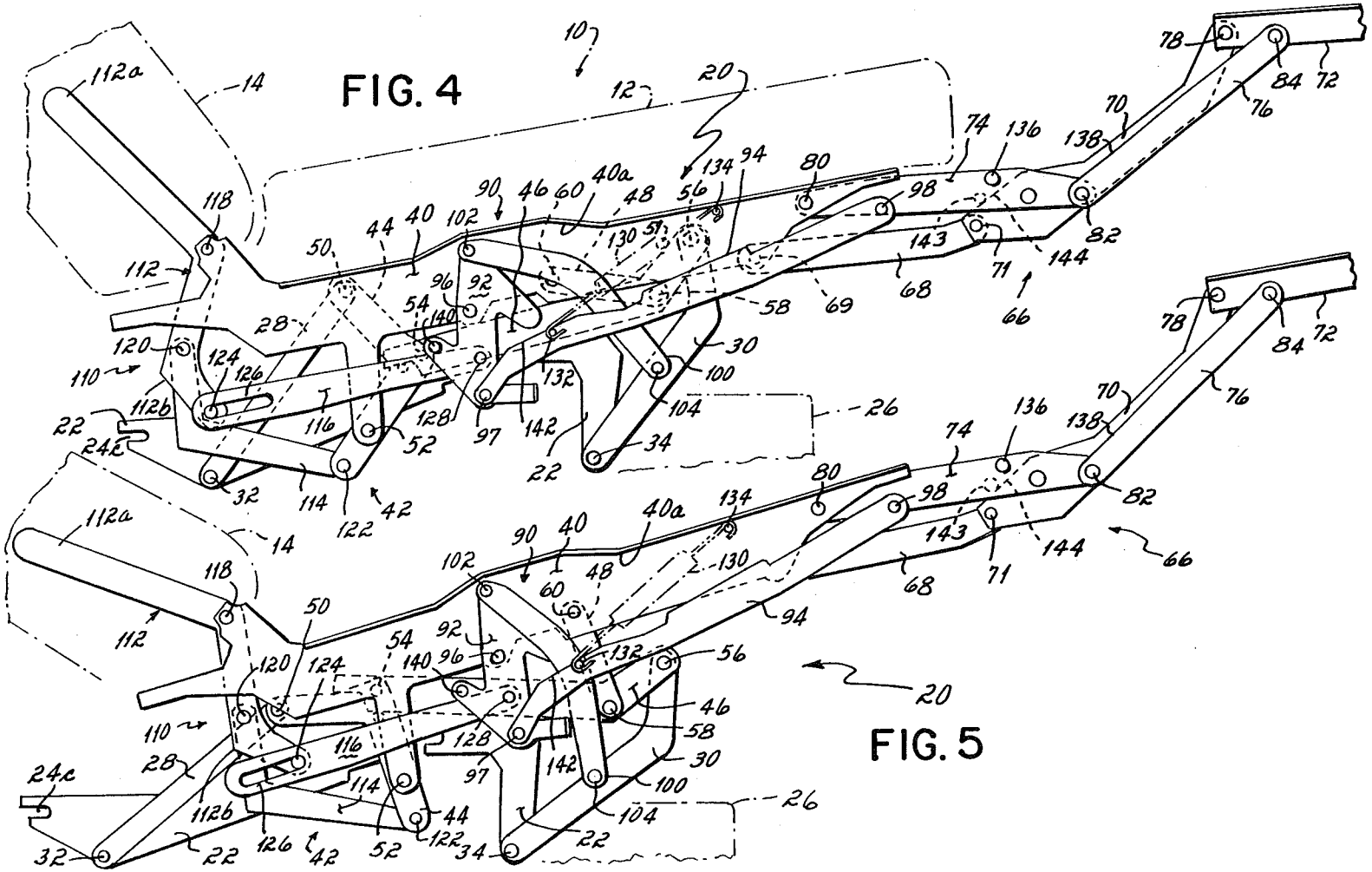
FIGS. 4 and 5 are side elevational views of the mechanism of FIG. 1, but illustrating the mechanism in a TV and fully reclined position, respectively.

When it is desired to move the linkage mechanism from the TV to the fully reclined position illustrated in FIG. 5, all that is required is for a person seated in the chair to lean back against the backrest 14. This has the effect of pivoting the rear seat actuating link 44 counterclockwise, as viewed in FIG. 4, and of simultaneously moving the upper ends of the front and rear seat drive links 30 and 28, respectively, further forwardly along with the seat link 40. This rearward pivoting movement of the backrest 14 and the attached backrest link 112 may continue until the pin 124 of the backrest link 112 engages the forward end of the slot 126 in the sequence link 116.

It is to be noted that with the linkage mechanism 20 in the fully reclined position illustrated in FIG. 5 and with the footrest fully extended, the mechanism is free to move from the fully reclined position (FIG. 5) to the TV position (FIG. 4) if while in the fully reclined position, a weight is applied to the footrest. This is an important attribute of the linkage mechanism 20 because it enables a person seated in the chair to push downwardly and retract the footrest while in the fully reclined position, and it also enables the footrest to collapse if, while the chair is in a fully reclined position, a second person should sit down on the fully extended footrest. In that event, the footrest would not break, but would instead cause the mechanism to move from the fully reclined to the TV position. This movement occurs as a consequence of the handle link 92 and connected footrest drive link 44 and backrest sequence link 116 being free to move to the retracted position of the footrest while the backrest is caused to move forwardly toward the TV position. This collapsing movement of the footrest is accommodated by the pin and slot connection 124, 126 of the backrest sequence link 116 and backrest link 112. But, for the provision of the slot 126 in the sequence link, a closing force applied to the footrest while the seat and backrest were fully reclined would either break the footrest or damage the mechanism.

In order to move the linkage mechanism 20 from the fully reclined position illustrated in FIG. 5 to the TV position of FIG. 4, all that is required is for a person to lean forwardly in the chair taking his weight off of the backrest 14. This causes the backrest to move to an upright position as a consequence of the weight of a person seated in the chair causing a force to be applied to the backrest link from the seat link via the rear seat actuating link and the backrest supporting link 114. Or, alternatively, a person seated in the chair can cause it to move from the fully reclined to the TV position by using his legs to push downwardly on the footrest.

In either the fully reclined or TV position of the mechanism, a downward force on the footrest mechanism 66 is transferred through the footrest drive link 94 and handle link 92 to the ratio connecting link 100 and rear seat actuating link 44, and thereby to the front and rear drive links 30 and 28, respectively.

While I have described only a single preferred embodiment of my invention, persons skilled in the art to which this invention pertains will appreciate numerous changes and modifications which may be made without departing from the spirit of my invention. Therefore, I do not intend to be limited except by the scope of the following appended claims:

I claim:

1. A linkage mechanism for use in a reclining item of action furniture having a movable seat and backrest, said mechanism comprising a base mounting plate, front and rear seat drive links pivotally mounted to the base mounting plate at locations spaced along the base mounting plate, a seat link, a rear seat actuating link pivotally connected by a first pivot connection to said rear seat drive link and to said seat link by a second pivot connection, said second pivot connection being located beneath said first pivot connection, a front seat pivot link pivotally connected to said seat link, a connecting link, said connecting link being connected at one end to said front drive link and at the opposite end to said rear seat actuating link, said connecting link being pivotally connected at a point intermediate its ends to said front seat pivot link, a backrest link pivotally connected to the seat link, a backrest support link pivotally connected at one end to said backrest link and at an opposite end to said rear seat actuating link, a footrest linkage pivotally connected to said seat link for movement between extended and retracted positions, footrest linkage actuating means for moving said footrest linkage and seat link between upright, TV and fully reclined positions, said footrest linkage being retracted in said upright position and extended in said TV and fully reclined positions, a backrest sequence link, a pin and slot connection between said backrest sequence link and said backrest link, and said backrest sequence link being operably connected to said footrest linkage actuating means so as to prevent movement of said backrest link when said footrest is fully retracted while permitting movement of said backrest link relative to said seat link whenever said footrest linkage and seat link are in either TV or fully reclined positions.

2. A linkage mechanism for use in a reclining item of action furniture having a movable seat and backrest, said mechanism comprising a base mounting plate, front and rear seat drive links pivotally mounted to the base mounting plate at locations spaced along the base mounting plate, a seat link, a footrest linkage pivotally connected to said seat link for movement between extended and retracted positions, footrest linkage actuating means for moving said footrest linkage between extended and retracted positions, a rear seat actuating link pivotally connected by a first pivot connection to said rear seat drive link and to said seat link by a second pivot connection, said second pivot connection being located beneath said first pivot connection, and the improvement which comprises a front seat pivot link pivotally connected at its upper end to said seat link, a connecting link, said connecting link being connected at one end to said front drive link and at the opposite end to said rear seat actuating link, said connecting link being pivotally connected at a point intermediate its ends to the lower end of said front seat pivot link.

3. A linkage mechanism for use in a reclining item of action furniture having a movable seat and backrest, said mechanism comprising a base mounting plate, front and rear seat drive links pivotally mounted to the base mounting plate at locations spaced along the base mounting plate, a seat link, seat supporting means for supporting said seat link from said front and rear seat drive links, a backrest link pivotally connected to the seat link, a backrest support link pivotally connected at one end to said backrest link and at an opposite end to said seat supporting means, a footrest linkage pivotally connected to said seat link for movement between extended and retracted positions, footrest linkage actuating means for moving said footrest linkage and seat link between upright, TV and fully reclined positions, said footrest linkage being retracted in said upright position and extended in said TV and fully reclined positions, a backrest sequence link, a pin and slot connection between said backrest sequence link and said backrest link, and said backrest sequence link being operably connected to said footrest linkage actuating means so as to prevent movement of said backrest link when said footrest is fully retracted while permitting movement of said backrest link relative to said seat link whenever said footrest linkage and seat link are in either TV or fully reclined positions.

4. The linkage mechanism of claim 3 wherein said seat supporting means includes a rear seat actuating link pivotally connected by a first pivot connection to said rear seat drive link and to said seat link by a second pivot connection, said second pivot connection being located beneath said first pivot connection.

5. The linkage mechanism of claim 4 wherein said seat supporting means further includes a front seat pivot link, said front seat pivot link having an upper end and a lower end, and said upper end of said front seat pivot link being pivotally connected to said seat link.

6. The linkage mechanism of claim 5 wherein said linkage mechanism further includes a connecting link, said connecting link being connected at one end to said front drive link and at the opposite end to said rear seat actuating link, said connecting link being pivotally connected at a point intermediate its ends to the lower end of said front seat pivot link.

* * * * *